United States Patent [19]

Daugirdas

[11] Patent Number: 4,882,876

[45] Date of Patent: Nov. 28, 1989

[54] DOOR OPERATOR WITH LOCKING MECHANISM

[75] Inventor: Kristupas Daugirdas, Wilmette, Ill.

[73] Assignee: Vapor Corporation, Chicago, Ill.

[21] Appl. No.: 328,097

[22] Filed: Mar. 23, 1989

Related U.S. Application Data

[63] Continuation of Ser. No. 209,464, Jun. 21, 1988.

[51] Int. Cl.[4] ..... E05B 65/10

[52] U.S. Cl. ..... 49/141; 49/118; 49/363; 49/449

[58] Field of Search ..... 49/141, 363, 449, 118, 49/360, 361, 362

[56] References Cited

U.S. PATENT DOCUMENTS

| | | | |
|---|---|---|---|
| 1,583,835 | 5/1926 | Hynes | 49/363 |
| 3,104,098 | 9/1963 | Daugirdas | 268/53 |
| 3,136,538 | 6/1964 | Dimmit et al. | 49/141 X |
| 3,269,058 | 8/1966 | Lynn et al. | 49/14 |
| 3,438,148 | 4/1969 | Lynn et al. | 49/13 |
| 3,745,705 | 7/1973 | Reddy | 49/362 X |
| 3,782,034 | 1/1974 | Lynn et al. | 49/13 |
| 3,916,567 | 11/1975 | Daugirdas | 49/28 |
| 4,087,939 | 5/1978 | Elguindy et al. | 49/118 |
| 4,198,786 | 4/1980 | Monot | 49/362 |

*Primary Examiner*—Philip C. Kannan
*Attorney, Agent, or Firm*—Francis J. Lidd

[57] ABSTRACT

Disclosed is an operator for a door mounted by frame means so as to be slidable along a track between open and closed positions. The door has a peripheral edge which is engaged to provide a positive locking of the door. The operator includes a shaft rotatably mounted alongside the door. A locking pawl is mounted to the shaft for rotation therewith so as to be movable between an unlocked position remote from a door edge and a locked position overlying the door edge so as to block the opening thereof. A lockout lever is also attached to the shaft for rotation therewith, and is movable between an idle position whereat the shaft is rotated to bring the locking pawl to its unlocked position and a lockout position whereat the shaft is rotated to bring the locking pawl to its locked position. An emergency lever is attached to the shaft for rotation therewith, and is movable between an idle position whereat the shaft is rotated to bring the locking pawl to its locked position and an open position whereat the shaft is rotated to bring the locking pawl to its unlocked position. A spring and a pneumatic actuator move the shaft back and forth in opposite directions of rotation so as to move the locking pawl between its locked and unlocked positions.

5 Claims, 11 Drawing Sheets

DOOR OPERATOR WITH LOCKING MECHANISM

This is a continuation of Ser. No. 209,464, filed 6/21/88.

BACKGROUND OF THE INVENTION

The present invention relates in general to a door operator having a locking mechanism for locking a sliding door in a closed position and also to permit opening of the door in a number of different operating conditions.

BRIEF DESCRIPTION OF THE RELATED ART

Door systems of a type wherein the doors slide along tracks under the force of pneumatic or electric actuators have been provided for a variety of vehicles, structures and buildings. Larger openings have been fitted with double doors which slide toward and away from each other. For a given opening, double doors have reduced mass and therefore require less energy to open and close, a feature especially important where the doors are opened and closed many times throughout the course of a work day. The reduced weight associated with double doors is also important for vehicular applications. While simple locking arrangements are sometimes suitable for locking one or more sliding doors of a stationary structure or building, vehicular-mounted doors require a more reliable locking, for reasons of safety. However, in mass transit vehicles where the sliding doors are repeatedly cycled, the locking arrangement must have a fast operating time and must be remotely actuable and compatible with other equipment associated with the door, such as door-moving actuators, safety annunciators, interlocks, and the like.

Sliding doors, especially those which are repeatedly opened and closed as in a mass transit vehicle, typically have mechanisms which are comprised of pluralities of components all of which move together in their respective ranges of motion as the doors are moved between their open and closed positions. One general type of locking mechanism engages the linkage and/or actuator mechanism attached to a door preventing movement of the linkage or mechanism and thereby ultimately preventing the door from opening in a manner not controlled by authorized personnel. This locking mechanism, which does not engage the door directly is known as a "secondary lock".

The secondary type of locking arrangement typically engages one or more components of the locking mechanism preventing its travel through its range of motion and, because of its interconnection with the other components of the mechanism, also prevents opening of the door. Once locked in this fashion, any pressure imparted to the door to attempt its opening is transmitted at least in part to the components of the mechanism, with the integrity of each component being relied upon to maintain the door in a closed or locked position. Examples of secondary locking arrangements for vehicular-mounted doors are given in U.S. Pat. Nos. 3,745,705; 4,087,939; and 4,198,786.

While generally satisfactory, consideration is being given to replacing secondary locking arrangements with other, more positive types of door locking systems. Such systems, however, to be commercially successful, must be compatible with other design objectives, such as space, weight and cost restraints. Also, the locking system must cooperate with other, perhaps preexisting systems associated with operation of the doors in a mass transit or other specialized environment.

SUMMARY OF THE INVENTION

It is therefore an object of the present invention to provide a door operator with a positive locking mechanism for sliding doors which directly engages the door to prevent its opening.

Another object of the present invention is to provide a door operator and locking mechanism for a double door system in Which redundant direct locking of each door is provided in a manner which does not rely on the integrity of any intervening linkage or actuating mechanism to maintain the door in the closed position.

Another object of the present invention is to provide a door operator of the above-described type in which the doors may be locked in a closed, out of service position and which the doors may also be openable in an emergency position in a manner which supercedes other controls over the door.

These and other objects according to the present invention, which will become apparent from studying the appended description and drawings is provided in (claim 1).

A lockout arm is also provided in one embodiment so as to be movable to a first position remote from the lockout lever and a second, lockout position which blocks the travel of the lockout lever to its other position, thus preventing the shaft from rotating so as to bring the locking pawl out of its locked position overlying the door edge. In one embodiment, the emergency lever cooperates with the lockout lever to bring the lockout lever out of its lockout position as the emergency lever is move to its emergency open position. This cooperation is provided by an emergency arm which is engagable with both the emergency lever and the lockout lever to move the emergency lever to its open position concurrent with moving of the lockout lever to its idle position. The emergency lever has two legs joined end to end in a generally v-shaped configuration. One leg of the emergency arm is engagable with the emergency lever so as to move the emergency lever to its open position. The one leg of the emergency arm also carries a projection engagable with the lockout arm so as to place the lockout arm in a manner which removes its blocking of the lockout lever, thereby freeing the shaft for rotation so as to bring the locking pawl out of its locking position.

BRIEF DESCRIPTION OF THE DRAWINGS

In the drawings, wherein like elements are referenced alike.

DETAILED DESCRIPTION OF THE PREFERRED EMBODIMENT

Figure 3:
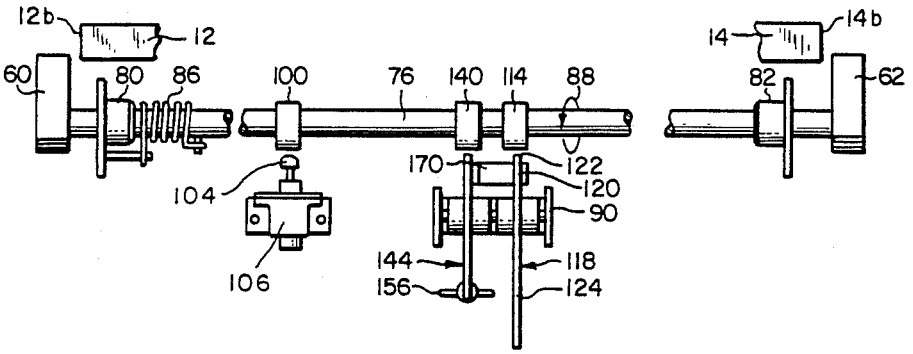
FIG. 3 is a plan view of internal apparatus disposed within an enclosed portion of FIG. 2.
Figure 4:
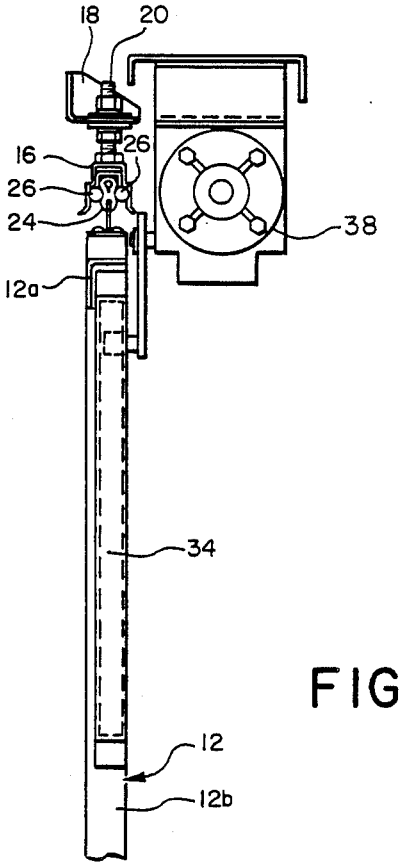
FIG. 4 is a fragmentary side elevational view of the doorway system of the preceeding figures.

Referring now to the drawings and initially to FIGS. 1–5, a doorway system for a mass transit vehicle is generally indicated at 10. The doorway system 10 includes a pair of doors 12, 14 suspended or hung from a slide track 16. The track 16 is mounted to a frame 18 through a plurality of mountings 20 which may be of either the rigid or the shock-absorbing type. Referring especially to FIG. 4, door 12 has an upper end 12*a* attached to a rail 24 having a pair of opposed concave channels formed therein, each for receiving a plurality of ball bearings 26 which provide a low friction rolling interface between rail 24 and the slide track 16. The doors 12,14 are moveable toward and away from each other in the directions of doubleheaded arrows 30 (see FIG. 1*a*). As illustrated in FIG. 1*a*, the doors, 12, 14 are brought together so as to close an opening of a type through which passengers may enter and exit a vehicle, such as a mass transit vehicle. In the preferred embodiment the doors, 12, 14 are moveable along track 16 in horizontal directions, and the doors are supported for such sliding at their upper ends. Guide channels 34, 36 are mounted at the outer peripheral ends 12*b*, 14*b*, of the doors 12, 14 respectively. Engines 38, 40 are attached to framework 18 by mounting brackets 42, 44, respectively. The engines 38, 40 rotatably drive output shafts 46, 48. Opening arms 50, 52 are secured to the output shafts 46, 48, respectively so as to rotate therewith. Follower rollers 54, 56 are rotatably mounted at the free ends of opening arms 50, 52 and travel through the guide channels 34, 36, respectively. Thus, upon energizing the engines 38, 40, the arms, 50, 52 are swung in generally opposed outward directions with the follower rollers 54, 56 reciprocating in guide channels 34, 36 as the doors are opened. The fully open position of the doors is indicated in the phantom in FIG. 1*a*. For example, referring to door 12, arm 50 is swung in a generally clockwise direction, the follower roller 54 initially traveling in guide channel 34 in a downward direction. As arm 50 swings through a vertically downward orientation, the follower roller 54 begins its upward travel in guide channel 34 and continues until the guide channel 34 is positioned as indicated in phantom in FIG. 1*a*. This transmits a laterally outwardly directed opening force to door 12 causing the door to slide along track 16 in a laterally outward direction, away from door 4. In the preferred embodiment doors 12, 14 are simultaneously advanced toward and away from each other upon closing and opening operations of the door system. Further details concerning the operation of the doorway system 10 are provided and commonly assigned U.S. Pat. No. 3,916,567 which is herein incorporated by reference. Although this patent illustrates the engines and opening arms at the lower ends of sliding doors, those skilled in the art will readily appreciate that with relatively simple modifications, the same engines and opening arms can be arranged as described above, adjacent the top ends of the doors.

It is important, especially for doorways systems of engine vehicles such as mass transit vehicles and alike that unauthorized opening of the doors be prevented. As mentioned above, secondary locking systems can be provided to block the travel of one or more components of the door operating system. In general terms, the output shafts 46, 48 could be prevented from turning once the doors are closed or alternatively the arms 50, 52, could be prevented from springing in a generally downward and outward directions. It will be appreciated by those skilled in the art, doorway systems presently used in mass transit vehicles have highly developed and often times complex mechanisms traveling or moving in response to opening and closing of the doors so as to provide interlocking with braking an annunciator systems. Any components of these mechanisms which travel in response to opening of door and which, if blocked, would prevent the door from opening could be locked by a secondary locking system.

Some operators of mass transit vehicles are contemplating the use of more positive, direct locking devices which directly engage the doors be opened and closed and which do not rely upon the structural integrity of the components locked by the secondary system or the interconnections of those components which limit and thereby define the path of travel of the components. In accordance with one aspect of the present invention, a locking mechanism is provided with locking pawls 60, 62 which are movable to the locked position illustrated in FIGS. 1*a*–1*c*, adjacent the upper ends 12*a*, 14*a* at the outer lateral edges of the doors 12, 14. For example, referring to FIG. 5, the locking pawl 60 is illustrated in its locked position partially overlying the upper end of door 12. Attempts at opening door 12 will move the door into contact with the locking pawl, with further opening of the door being effectively locked. In the preferred embodiment, the outer lateral edge 12*b* of the door 12 is positioned very close to the locking pawl when the door is in its fully closed position with a negligible amount of "play" being experienced upon an attempted opening of the door. The other door 14 and its locking mechanism is preferably substantial identical to the door 12 and its locking mechanism.

Figure 5A:
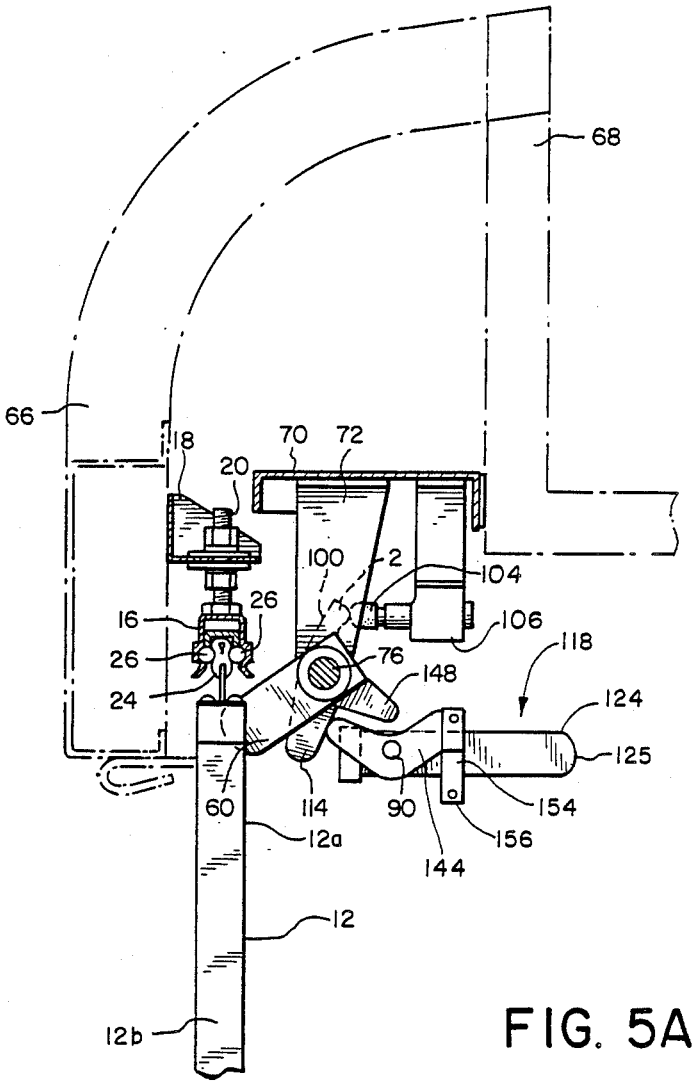
FIG. 5*a* is a fragmentary cross-sectional elevational view taken along line 5—5 of FIG. 1*a;*
Figure 5B:
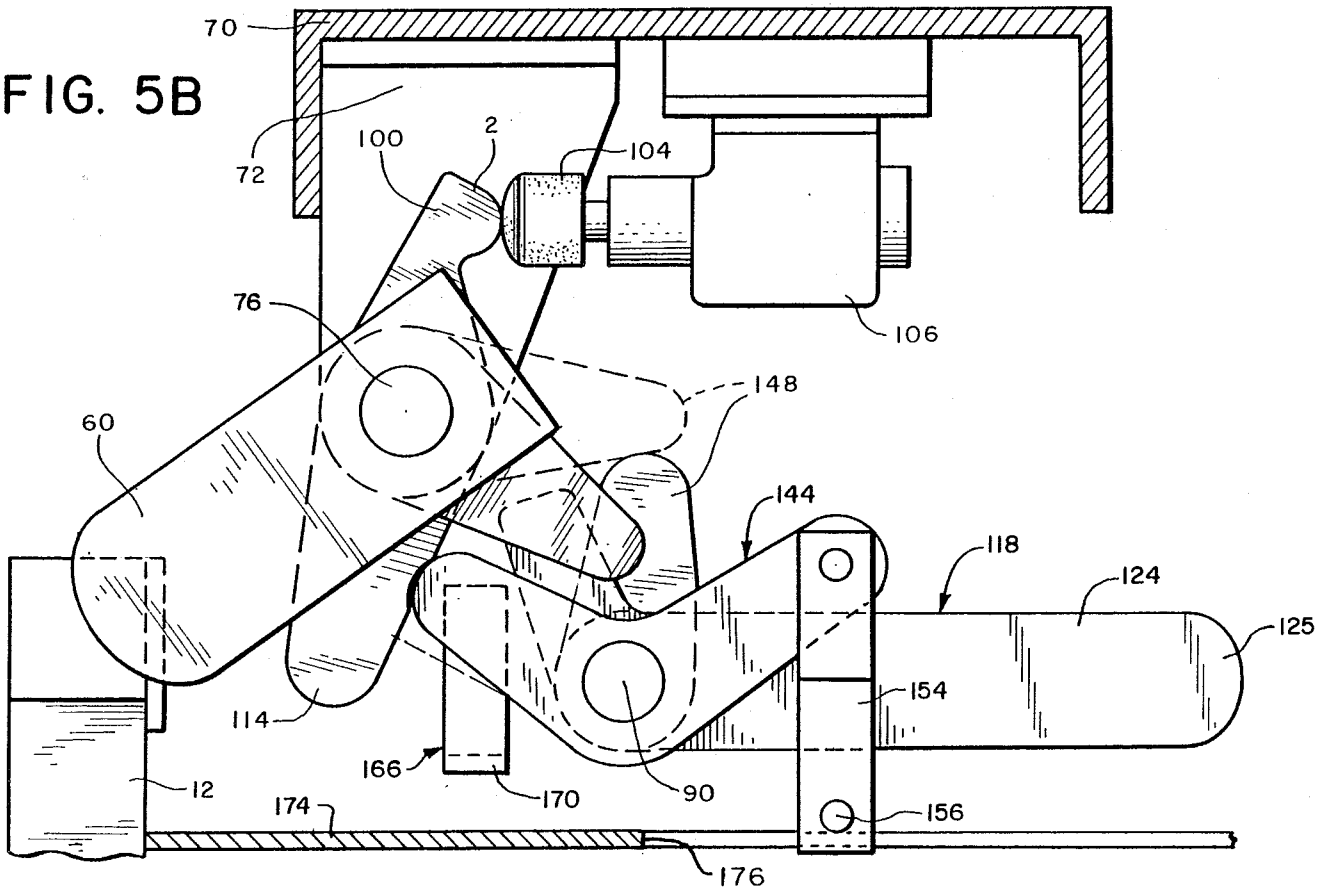
FIG. 5*b* is a fragmentary view showing the actuator portion of the doorway system of FIG. 5*a* in greater detail, the actuator system shown is in a normally closed position.

Referring now to FIG. 5, a frame 18 referred to above is attached to a outer wall 66 of a mass transit vehicle, although as will be seen herein, the principals of the present invention may be embodied in other types of vehicles and in stationary structures as well as buildings. The wall 66 includes a generally vertical internal wall 68. A generally horizontal structure member 70 is connected between the walls 66, 68 and comprises a rigid connection to the frame on which track 16 is mounted. Rigid hangers 72 support a generally cylindrical operating shaft 76, which extends generally parallel to and coextensive with the fully closed doors 12, 14.

Figure 1A:
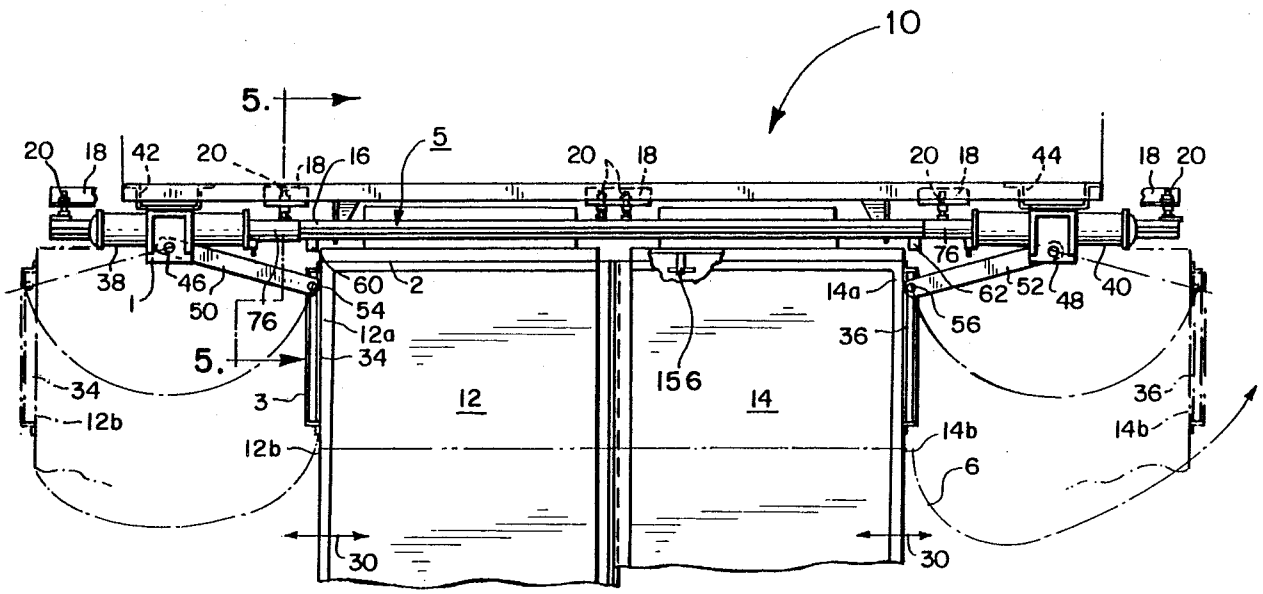
FIGS. 1*a*–1*c* together comprise an elevational view of a doorway system having a operator according to principles of the present invention.
Figure 1B:
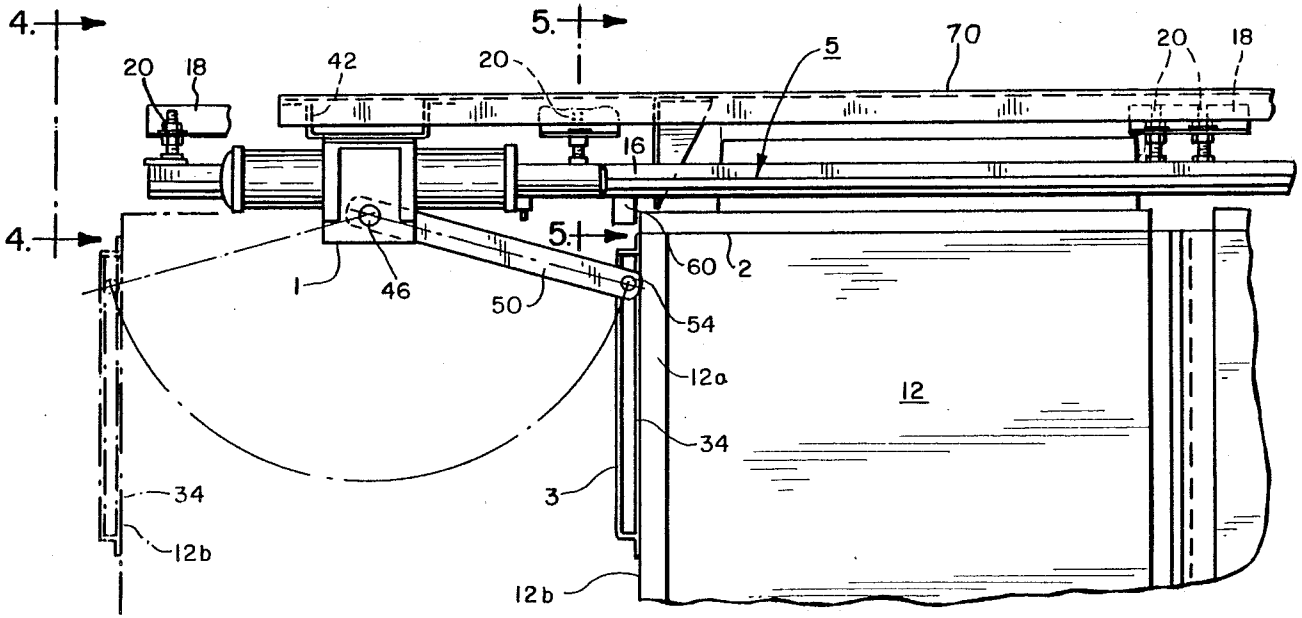
Figure 1C:
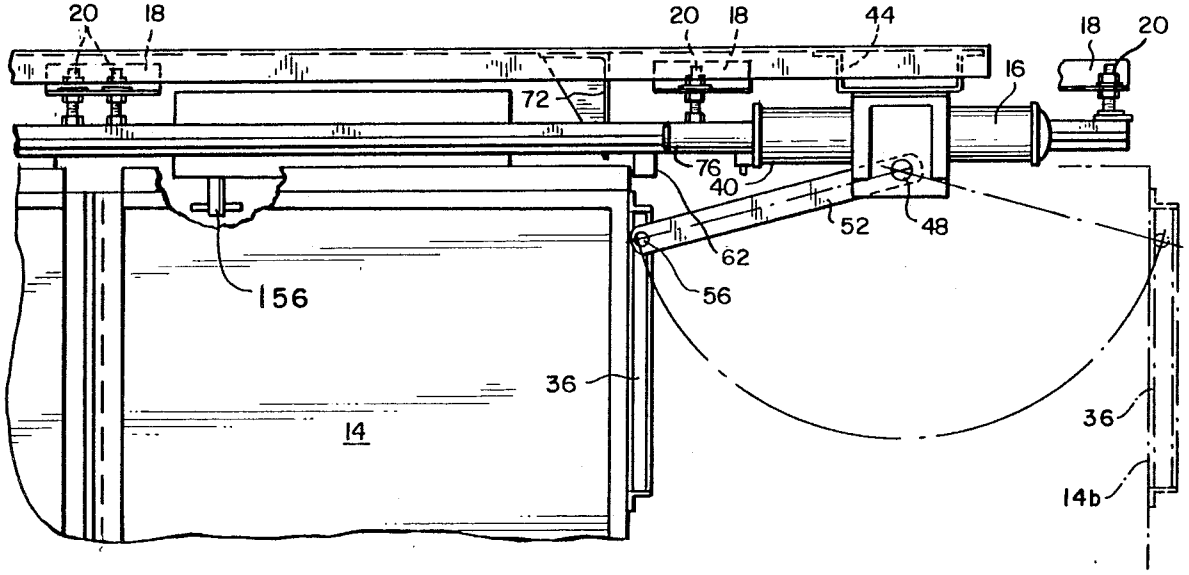
Figure 2A:
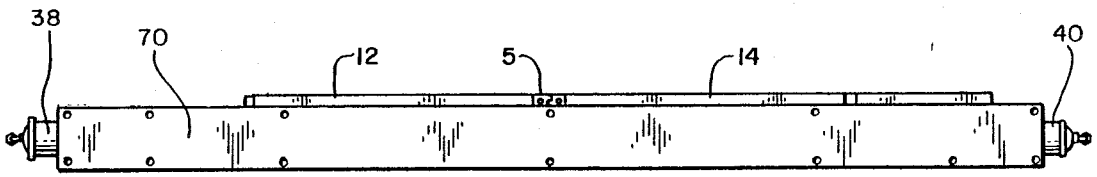
FIGS. 2*a*–2*c* together comprise a top plan view of the doorway system of FIG. 1.
Figure 2B:
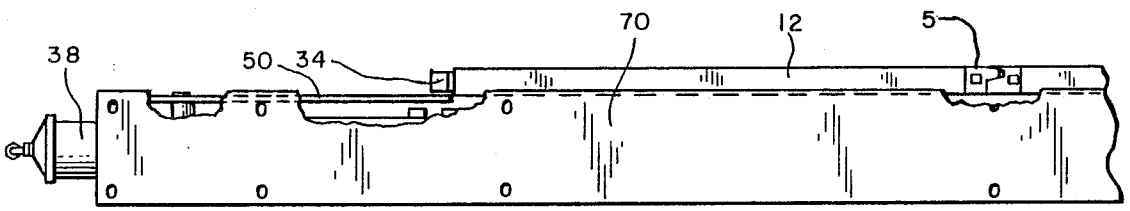
Figure 2C:
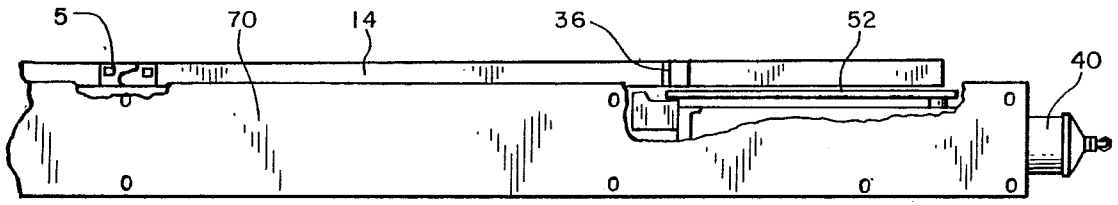

Referring to FIG. 1*a*, shaft 76 is slightly longer than the width of both doors, 12, 14, generally by an amount which allows mounting of the locking pawls 60, 62 to the outer ends of the shaft.

Referring to FIG. 3, shaft 76 is mounted for rotation in mounting blocks 80, 82 which in turn are mounted to structural member 70. A helical spring 86 biases shaft 76 for rotation in the direction of arrow 88 so as to bring the locking pawls 60, 62 in an overlying relationship with the outer lateral edges 12*b*, 14*b* of doors 12, 14. It is generally preferred that shaft 76 extend parallel to the major surfaces of doors 12, 14 and hence, parallel to their direction of opening and closing. With reference to again to FIG. 3, an auxiliary shaft 90 parallel to but shorter than shaft 76 is mounted through brackets (not shown) through structural member 70 or other rigid structure of the vehicle. As will be seen, a series of levers are fixedly attached to shaft 76 and the series of arms, engagable with the levers are independently mounted on shaft 90.

Figure 6A:
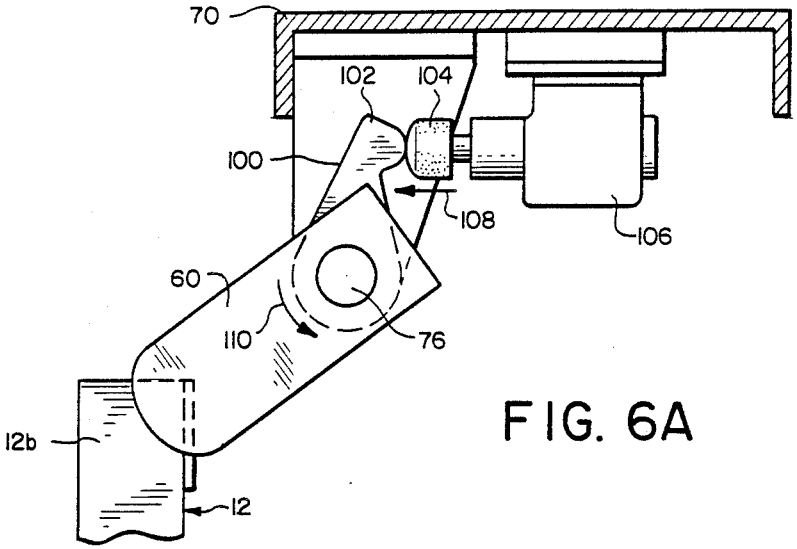
FIGS. 6*a* and 6*b* are simplified views showing the locking pawl of the actuator system in normally locked and unlocked positions respectively.

An opening lever 100 is fixedly attached to shaft 76 for rotation therewith. The opening lever 100 is illustrated in the top plan view of FIG. 3 and is seen most clearly in the fragmentary side elevational view of FIG. 6*a*. The opening lever 100 includes an enlarged camming head 102 positioned adjacent the movable tip 104 of an unlocking actuator 106. The unlocking actuator 106 may for example comprise an electrically operated solenoid but preferably comprises a pneumatic cylinder which advances the tip 104 in the outward direction of arrow 108.

Figure 6B:
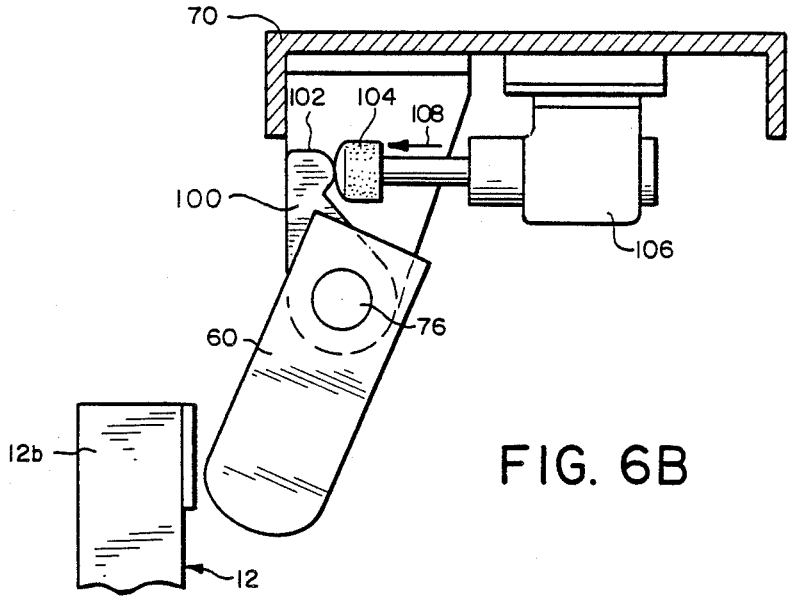

As the unlocking actuator 106 is energized, its tip 104 moves in an outward direction engaging the enlarged head 102 so as to rotate shaft 76 in the direction of arrow 110. Since locking pawl 60 is fixedly attached to shaft 76, the locking pawl is also rotated in the direction of arrow 110 so as to free its blocking of the lateral edge of door 12. For a close tolerance arrangement between the locking pawl 60 and door 12, the actuator 106 will bring the locking pawl out of engagement with outer, lateral edge of door 12. The open or rotated position of shaft 76 in response to operation of actuator 106 is illustrated in FIG. 6*b* and as can be seen therein, the locking pawl 60 is located away from the lateral edge 12*b* of door 12.

Figure 7A:
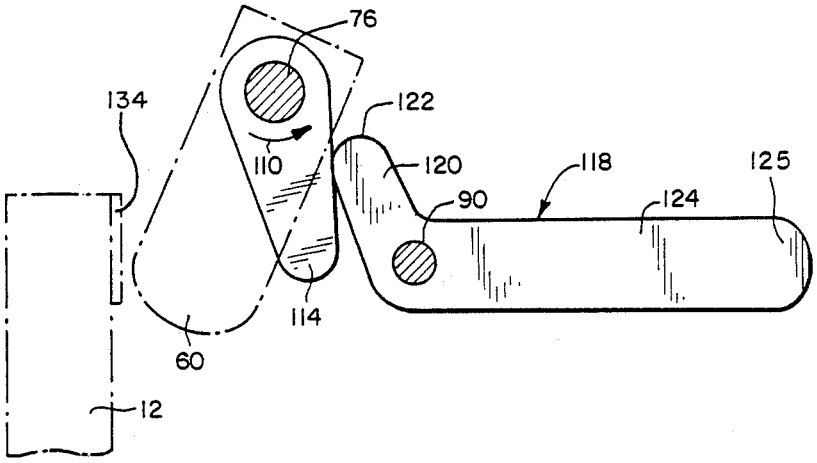
FIGS. 7*a* and 7*b* are fragmentary views of the actuator lockout portion of the system in idle and lockout positions respectively.
Figure 7B:
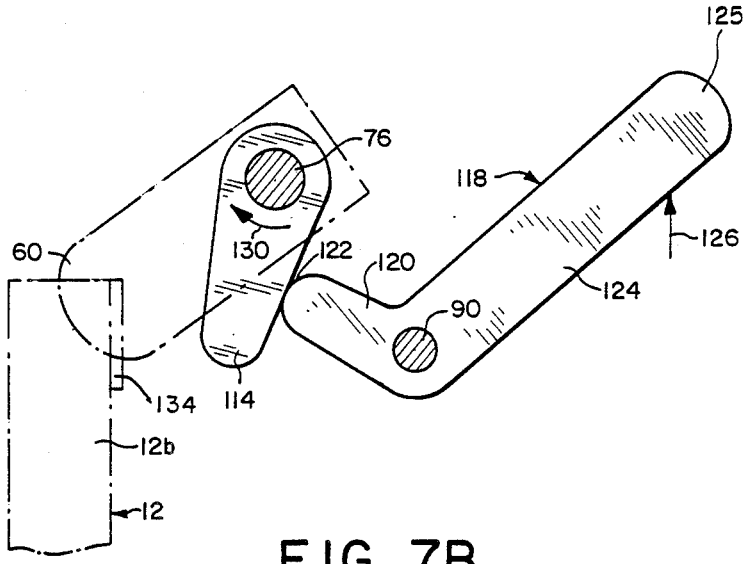

Referring again to FIG. 3, a lockout lever 114 is fixedly attached to shaft 76 for rotation therewith between idle and lockout positions as will be illustrated in FIGS. 7*a*, 7*b*, respectively. In its idle position, the lockout lever 114 is rotated away from door 12, hence corresponding to a rotation of shaft 76 in the direction of arrow 110 in which the doors are unlocked, the locking pawls 60 and 62 being in advanced away therefrom. A lockout on arm 118 is mounted to shaft 90 for rotation thereabout. Lockout arm 118 includes a first leg 120 with a lever-engaging camming surface 122 and a second manually graspable leg or handle 124. The handle 124 as illustrated in FIG. 7*a* is shown in its normal operating position in which the handle has been pulled in a downward direction. In FIG. 7*b* the handle is pushed in the upper direction of arrow 126 thereby rotating the camming surface 122 about shaft 90, contacting the lockout lever 114 and causing the lever and hence the shaft 76 attached thereto to rotate in the direction of arrow 130. The rotation of shaft 76 brings locking pawl 60 into engagement or at least overlying the outer lateral end 12*b* of door 12, thus locking the door in the fully closed position. In the preferred embodiment, a camming plate 134 is attached to the major surface of door 12 nearest the locking pawl 60. Should door 12 be fully opened or in a partially closed position, the locking pawl 60 Will engage the camplate 134 and slide there against as the door is moved to a fully closed position, whereupon the locking pawl is cleared to travel in the fully locked position of FIG. 7*b*. The lockout lever 114 forms an overcenter or toggle arrangement with leg 120 of the lockout arm 118, when the arm is in it upper or lockout position. As a result, the lockout lever 114 is blocked from returning to its first, outer position of FIG. 7*a* despite rotational forces applied to shaft 76 in the direction of arrow 110. The lockout features illustrated in FIGS. 7*a* 7*b* can be employed for example, to lock the doors of a transit vehicle when the vehicle is being stored.

Figure 8A:
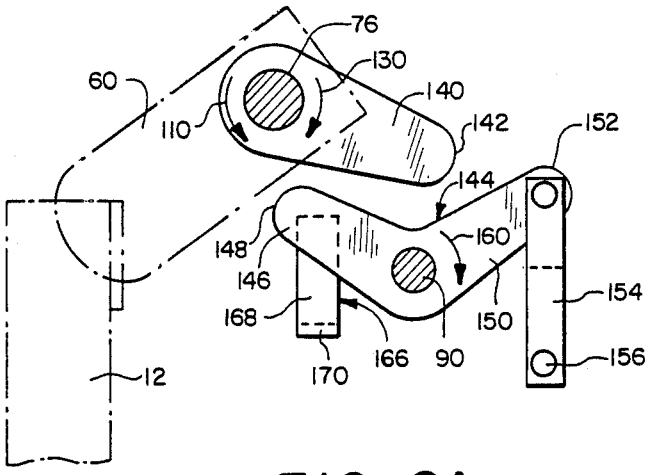
FIGS. 8*a* and 8*b* are fragmentary views of the emergency opening portion of the system shown in normal and emergency open positions, respectively.
Figure 8B:
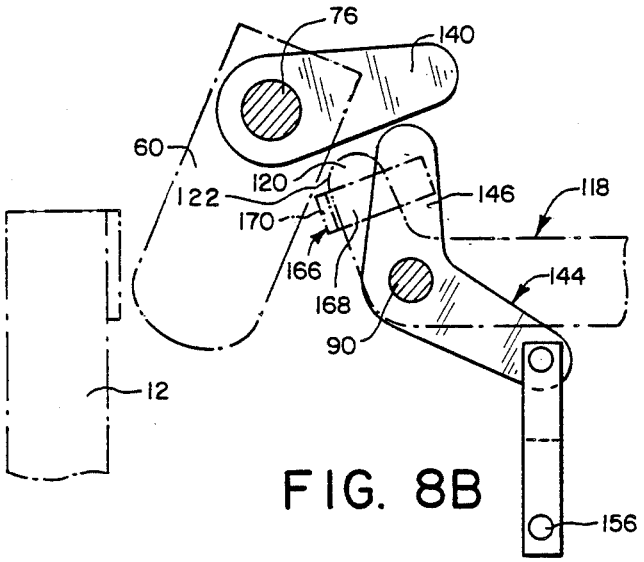

Referring again to FIG. 3, an emergency lever 140 is fixedly attached to shaft 76. Referring to FIGS. 8*a*, 8*b* the emergency lever 140 has a free end 142 for camming engagement with an emergency arm generally indicated at 144 and mounted for rotation about shaft 90. The emergency arm 144 includes a first leg 146 having a camming surface 148 at its free end and a second leg 150 joined end to end with the first leg 146 to form a generally v-shaped configuration. The second leg 150 has a free end 152 to which is pinned an arm 154 having a manually graspable handle 156. FIG. 8*a* shows the emergency arm in a first, normal or idle position in which the camming surface 148 is remotely located from the emergency lever 140.

FIG. 8*a* shows the locking pawl 60 in a fully locked position. When the locking pawl is moved to the open or unlocked position, the emergency lever 140 is moved further away from the emergency arm 144, with rotation in the direction of arrow 110 (see FIG. 8*a*). Thus, during normal operation the spring 86 rotates shaft 76 in the direction of arrow of 130 so as to move the pawl 60 to its locked position. When opening of the doors is desired, the actuator 106 is energized so as to rotate shaft 76 and hence the emergency lever 140 in the direction of arrow 110.

Assuming the fully locked position of FIG. 8*a*, it is sometimes desirable to initiate opening of the doors without using actuator 106 for this purpose, as was explained above. With the doors in the locked position, the handle 156 is pulled in a downward direction thereby rotating the emergency arm 144 in the direction of arrow 160 to bring the camming surface 148 into engagement with the emergency lever 140. Further rotation of the emergency arm rotates the emergency lever 140 and hence shaft 76 in the direction of arrow 110 thereby moving the locking pawl to its open or unlocked position, out of engagement with door 12, as illustrated in FIG. 8*b*. With reference to FIG. 8*b*, the emergency lever 140 and leg 146 of arm 144 form an over center or toggle arrangement in which the angular position of shaft 76 is stably fixed until the emergency handle is reset by pushing in a generally upward direction to restore the emergency arm to the orientation illustrated in FIG. 8*a*.

As mentioned above, the lockout arm 118 when rotated to its upper or lockout position blocks rotation of the lockout lever 114 and hence the shaft 76 in a manner which would remove the engagement of locking pawl 60 from door 12. Unless steps are taken to positively displace either the lockout lever or lockout arm from the over center or locked condition, operation of the emergency handle 156 will not be effective in unlocking the doors 12, 14. There is accordingly provided an L-shaped member generally indicated at 166 which protrudes from a leg 146 of emergency arm 144. The L-shaped number 166 includes a first leg 168 while it or otherwise secured to leg 146 of emergency arm 144. A second leg 170 is attached end to end to leg 168 and forms a generally right angle therewith.

The second leg 170, visible within FIG. 3 extends past the leg 120 of lockout arm 118. Referring to FIG.

9, with the lockout arm and lockout lever 114 moved to their lockout positions, handle 156 is pulled in a downward direction, rotating emergency arm 144 in the direction of arrow 160. Rotation of this arm causes an engagement of leg 170 with leg 120 of lockout arm 118. Further rotation of emergency arm 144 causes the lockout arm 118 to also be rotated in the direction of arrow 160, thereby moving the lockout arm to the idle position illustrated in FIG. 7*a*, and allowing the torque applied by leg 146 of the emergency arm to the emergency lever 140 to rotate shaft 76 in the direction of arrow 110, thus bringing locking pawl 60 out of engagement with door 12.

Figure 9:
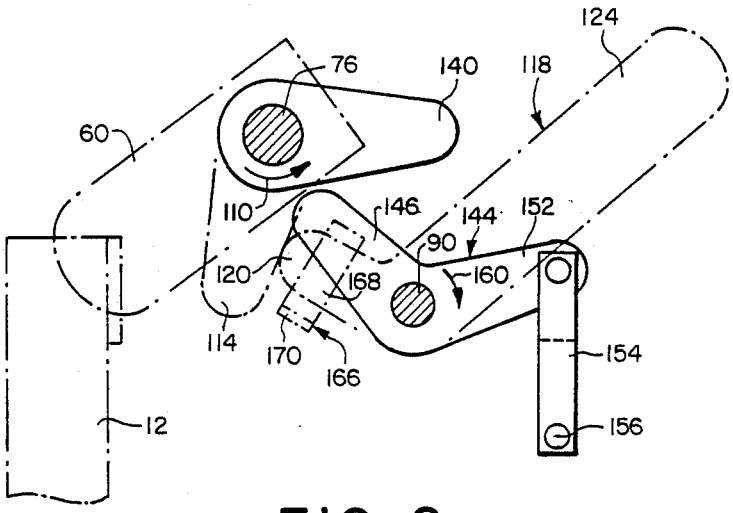
FIG. 9 is a fragmentary view of the actuator system being moved to an emergency open position by overriding a previous lockout condition of the system.

In summary, with the lockout lever and arm in the configuration illustrated in FIG. 7*b*, and the emergency arm and lever in the configuration illustrated in FIG. 8*a*, tension applied to handle 156 causes rotation of the emergency arm 144 bringing leg 170 into engagement with the leg 120 of the lockout arm 118, as illustrated in FIG. 9. The lockout and emergency arms are bought into engagement with each other through the L-shaped member 166. Thereafter, further tension applied to handle 156 results in a clearing of the lockout arm 118, resulting in the configuration illustrated in FIG. 7*a* and further results in rotation of shaft 76 and travel of the emergency lever 140 to the open position as illustrated in FIG. 8*b* wherein the locking pawl 60 clears door 12.

If desired, the handle of lockout arm 118 can be raised so as to clear the emergency arm from its over center or toggle engagement with the emergency lever 140 thereby allowing clearance between the lockout lever and lockout arm to promote rotation of shaft 76 in the direction of arrow 130 to lock the door 12 in its closed position.

It is sometimes desirable to limit access to the lockout arm by unauthorized personnel, and to prevent its unintentional engagement in an emergency situation. Accordingly, the handle 156 of the emergency arm is dropped substantially lower than the position of handle 124 of the lockout arm and the actuator and locking mechanism is preferably enclosed by a lower wall 174. An opening 176 is provided in wall 174, allowing access to the handle 156 of the emergency arm. Further, it may be desirable to dimension the legs of emergency arm 144 such that it is difficult to reset the emergency handle to its normal position after being pulled, thereby requiring removal of wall 174 to gain a greater mechanical advantage, allowing the handle to be pushed to its upper position. The opening 176 may be made only large enough to allow a few fingers of a person's hand to grasp the handle 156. This is adequate to apply the necessary tension force in a downward direction for the emergency opening of the doors. However, without tools and special equipment aperture 176 is not sufficiently large to allow a person to apply the upward force necessary to clear the emergency arm from its over center or toggled position and thus the wall 174 must be removed.

In addition, it is preferred that the handle 156 be painted or otherwise marked so as to be considerably more visual than the handle 124. The mechanism above wall 174 is usually only dimly lighted and the presence of handle 124 Can easily be made visually unobvious. Further, the free end 125 of handle 124 is preferably positioned away from the opening 176 so as not to be visible therefrom, thereby offering only a minimal visual clue of its existence to unauthorized personnel not familiar with the mechanism. In this manner, the lockout arm can be made readily accessible to trained, authorized personnel but still be made virtually inaccessible to unauthorized personnel. Referring to one aspect of the present invention, locking, unlocking, lockout and emergency opening operations, with override of the lockout is provided with levers and arms directly connected to their respective mounting shafts without a lost motion coupling. This significantly increases the reliability of the locking mechanism and provides a fool-proof interengagement between the various sub systems of the locking mechanism as explained above.

Unlike the levers fixedly attached to shaft 76 for common rotation therewith, the arms 118, 144 are independently rotatable about shaft 90 to provide advantages which will now be explained.

In summary, the levers 100, 114, and 140 are fixedly attached to shaft 76 for rotation therewith. It is generally preferred, according to one aspect of the present invention that shaft 76 be moved between two discreet angular positions, one corresponding to the locking of the door 12, 14, and the other corresponding to the unlocking thereof, with no intermediate position of the shaft corresponding to a continuous or prolonged operating condition, being provided. Further, a resilient bias force is provided to urge the shaft to one of its two stable positions. According to one aspect of the present invention it is preferred that the position urged by the bias spring be the locked position, with the doors locked at their outer lateral ends by the locking pawls 60, 62. Thus, upon a loss of energy to the control system of the vehicle, the doors will be maintained in a locked position thereby allowing operators of the vehicle to maintain control over the position of the doors.

As can be seen from the above, a door actuator has been provided with a locking mechanism which directly contacts the doors to be locked thereby insuring a positive or direct locking thereof. With a minimum number of inexpensive components, a door actuator and locking mechanism has been provided for door opening, door closing, lockout and emergency opening features into engaging with one another to provide a number of operating configurations for the security of the vehicle and the emergency exit therefrom. The door actuator and locking mechanism as explained above simultaneously operates with respect to both doors 12, 14, the locking and unlocking of door 14 being substantially identical to that described above with respect to door 12. The levers and their engaging arms transmitting simultaneously identical place of the locking pawls which are connected to a common shaft. Various modifications can be made to the above-described embodiment, for example although only two locking pawls have been described above, it will now be appreciated that three or more locking pawls can be connected to a common shaft to receive identical displacements. Further, only one set of manually engageable handles for the lockout and emergency subsystems have been described although it will now become apparent multiple handles, arms and levers may be readily associated with a common shaft to provide alternative operating points for remotely actuating locking pawls.

Further, although 2 sliding doors have been described above it will now become apparent that the door actuator and locking mechanism described above can be readily employed with only a single sliding door.

Those skilled in the art will readily appreciate that the door actuator and locking mechanism described above may be readily employed with vertically sliding doors such as overhead roll up doors of buildings and other stationary structures, for example.

It is generally desired for a number of reasons that the door actuator and locking mechanism be located at the upper ends of the doors, remote from the floors of a vehicle and a pedestrian traffic thereacross. However, it is possible to install the door actuator and lock-in mechanism in a recess below the floor of a vehicle.

It is generally preferred that the arms, levers and shafts 76, 90 described above, be made of metal or the like material having sufficient strength to provide a desired factor of safety for the operating mechanism.

It will be readily apparent to those skilled in the art that modifications and variations of the above will still fall within the general concept of the invention. For this reason, the invention is not intended to be limited to the particular features described described above, but rather by the claims which follow.

What is claimed is:

1. In a power operator for a vehicular door said door mounted by frame means so as to be driven by said operator along a track between open and closed positions, the improvement comprising:

a generally rectangular door having structural members, and structurally integrated surfaces;

an edge defined by said door surfaces;

means mounting a locking pawl to said frame for selectively abutting and clearing said edge;

means in said mounting means for moving said pawl between a door unlocked position clearing said edge and a door locked position abutting said edge, so as to prevent opening of said door when said pawl and edge are in abutment; and, means sequentially actuating said operator and pawl moving means so as to positively lock said panel in a closed position.

2. The operator of claim 1, wherein said mounting and moving means further comprise:

a shaft alongside said door;

means mounting said shaft to the frame means for rotation about a longitudinal axis thereof:

means mounting said pawl on said shaft for rotation therewith; and, means rotating said shaft in opposite directions about said axis, thereby moving said pawl from an unlocked position disengaged from said latch to a locked position engaging said latch.

3. The operator of claim 2 where said moving means further comprises:

a lockout lever attached to said shaft for rotation therewith;

means moving the lock out lever between an idle position whereby the shaft is rotated to bring the locking pawl to its unlocked position, and a lockout position where the shaft is rotated to bring the locking pawl to its locked position; and, an emergency lever attached to the shaft for rotation therewith;

means moving the emergency lever between an idle position where the shaft is rotated to bring the locking pawl to its locked position, and an open position where the shaft is rotated to bring the locking pawl to its unlocked position.

4. The operator of claim 2 further comprising a double-ended emergency arm movable between a first position and a second operating position, the arm including a manually graspable handle at one end thereof and the arm having another end engageable with the emergency lever to move the emergency lever to its open position as the emergency arm is moved to its operating position.

5. The operator of claim 2 further comprising rotational bias means for biasing the shaft in a first direction of rotation so as to move the locking pawl to its locked position, and an emergency arm movable between a first position out of contact with the emergency lever to allow the emergency lever to move to its idle position under the force of the bias means and a second position engageable with the emergency lever to move the emergency lever to its open position so that, with displacement of the emergency lever, the shaft is rotated to bring the locking pawl to its unlocked position thereby allowing the door to be opened.

* * * * *